US006102570A

United States Patent [19]

Bull

[11] Patent Number: 6,102,570

[45] **Date of Patent: *Aug. 15, 2000**

[54] MODIFIED SOFT BAG EXPANDERS

[75] Inventor: Jan Bull, Colorado Spring, Colo.

[73] Assignee: Monarch Luggage Company, Inc., Brooklyn, N.Y.

[ * ] Notice: This patent is subject to a terminal disclaimer.

[21] Appl. No.: 09/276,461

[22] Filed: Mar. 25, 1999

Related U.S. Application Data

[63] Continuation-in-part of application No. 09/085,477, May 27, 1998, Pat. No. 6,022,146.

[51] Int. Cl.[7] ..... A45C 7/00

[52] U.S. Cl. ..... 383/127; 383/33

[58] Field of Search ..... 383/127, 33, 35, 383/104

[56] References Cited

U.S. PATENT DOCUMENTS

| | | | |
|---|---|---|---|
| 4,993,846 | 2/1991 | Diamond et al. | 383/127 |
| 5,179,600 | 1/1993 | Bailey et al. | 383/127 |
| 5,322,362 | 6/1994 | Smith | 383/127 |
| 5,499,874 | 3/1996 | Tang | 383/127 |

*Primary Examiner*—Jes F. Pascua
*Attorney, Agent, or Firm*—Stroock & Stroock & Lavan LLP

[57] ABSTRACT

A soft bag expander comprising a bottom panel having at least two bottom fold lines along opposite sides thereof; a first inner side panel and a second inner side panel affixed to said bottom panel along a first fold line and second fold line and each inner side panel being rotatable about the fold line to extend upwards from the bottom panel; a top panel having at least two top panel fold lines along opposite sides thereof; a first outer side panel and a second outer side panel, each outer side panel being disposed on a respective inner side panel, a respective middle fold line transversing each outer side panel formed parallel to the bottom fold line, each outer side panel extending from a respective top panel fold line to a position below each respective fold line; a resilient member resiliently joining a respective one of the outer side panels to a respective inner side panel to bias the respective side panels from a closed position into an open position, the inner side panels being positioned adjacent to the bottom panel in the closed position and the inner side panel extending upwards from the bottom panel in the open position. Other forms of the invention use side panels affixed to both the bottom and top panels with a separate inner panel biased to the to the side panels. Yet another embodiment of the invention uses pairs of hooks and holes or slots to which the resilient member is strung. An additional embodiment of the invention contains break lines along the top panel making the expander particularly suited for expanding tapered or satchel type bags.

6 Claims, 8 Drawing Sheets

100
200
202
204
208
210
212
214
2
5
110
120a
120b
130a
130b
132a
132b
134a
134b
140
150a
150b
160a
160b
166a
166b
168a
168b
170a
170b
206

MODIFIED SOFT BAG EXPANDERS

CROSS REFERENCE TO RELATED APPLICATIONS

This application is a continuation in part of U.S. patent application Ser. No. 09/085,477 filed May 27, 1998, U.S. Pat. No. 6,022,146 the contents of which are incorporated herein by reference.

BACKGROUND OF THE INVENTION

The present invention relates to a device used for expanding articles such as soft bags at the point of sale and in particular to collapsible soft bag expanders.

Retail stores such as K Mart or Wal-mart often display soft bags, such as tote bags, luggage and the like. Many of these bags have a tapered appearance or may be oddly shaped. It is desirable to display the bags in an expanded form in order to catch the attention of the ultimate consumer. Many of these bags are manufactured overseas and then imported into the United States. Soft bags are not generally shipped in the expanded condition because shipping costs tend to be very high for bulky materials as a result of the wasted space in an expanded bag. Alternatively, labor costs for expanding the bags at the point of sale can also be expensive. Therefore, it is advantageous to have a bag expander inserted into the soft bag at the point of manufacture, compress the bag and expander and ship the bag in its compressed form. Then, when the bag reaches the point of sale, the retail seller need only remove force from the bag and the expander inside will return to its expanded shape to puff the bag up into its fully expanded form.

Bag expanders are known in the art from U.S. Pat. Nos. 3,934,803, 4,077,451, 4,141,399 and 4,993,846, the contents of which are incorporated herein by reference. Each of these patents describe a device for expanding soft bags using various mechanisms. Although the prior art expanders have been considered satisfactory, they suffer from disadvantages. For example, some only provide stable support at a single position within the bag and do not provide support throughout the bag. Accordingly, it is desirable to provide an improved expander.

SUMMARY OF THE INVENTION

A soft bag expander is provided having a bottom panel having at least two bottom fold lines along opposite sides thereof. A first inner side panel and a second inner side panel are affixed to said bottom panel along the first fold line and second fold line. Each inner side panel is rotatable about the fold line to extend upwards from the bottom panel. A top panel includes at least two top panel fold lines along opposite sides thereof. A first outer side panel and a second outer side panel are each disposed on a respective inner side panel. A respective middle fold line transverses each outer side panel and is formed parallel to the bottom fold line. Each outer side panel extends from a respective top panel fold line to a position below each respective fold line. A resilient member resiliently joins a respective one of the outer side panels to a respective inner side panel to bias the respective side panels from a closed position into an open position. The inner side panels are positioned adjacent to the bottom panel in the closed position and the inner side panel extends upwards from the bottom panel in the open position. Other embodiments of the invention employ side panels affixed to both the bottom and top panels with a separate inner panel biased to the top of the side panels. Yet another embodiment of the invention uses pairs of hooks and holes or slots to which the resilient member is strung. In an additional preferred embodiment, the top panel contains break lines allowing the expander to conform to the top of and be used in tapered bags or satchels.

Accordingly, it is an object of the invention to provide an improved expander.

Still other objects and advantages of the invention will in part be obvious and will in part be apparent from the specification and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a better understanding of the present invention, reference may be had to the accompanying drawings in which.

DETAILED DESCRIPTION OF THE INVENTION

Figures 1, 2, 3:
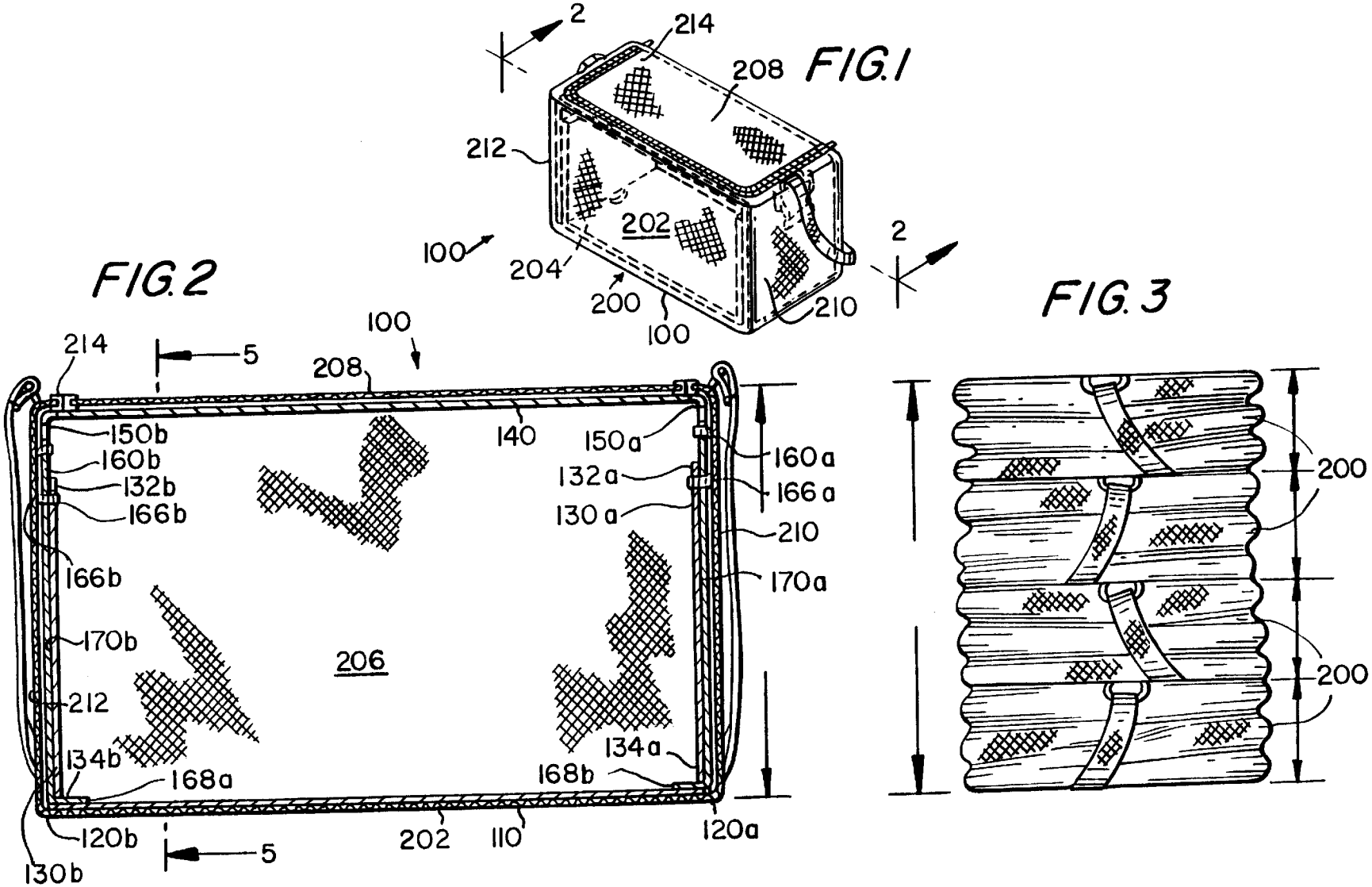
FIG. 1 is a perspective view of a soft bag containing an expander in accordance with the first embodiment of the invention.
FIG. 2 is a cross-sectional view along line 2—2 of FIG. 1.
FIG. 3 is a side elevational view of four compressed soft bags as they would appear during shipping.

Reference is made to FIGS. 1–7, which show a soft bag 200 and an expander 100, constructed in accordance with the invention, within soft bag 200. Soft bag 200 may come in a number of shapes and sizes. However, soft bag 200 can generally be considered to form a six sided enclosure. By way of example, soft bag 200 includes a bottom 202, opposed sides 204, 206, a top 208 and side panels 210, 212. Top 208 includes a zipper 214 for providing access within.

Expander 100 is disposed within soft bag 200 and includes a bottom panel 110 having at least two bottom fold lines 120*a* and 120*b* along opposite sides thereof. A first inner side panel 130*a* and a second inner side panel 130*b* are affixed to said bottom panel 110 along first fold line 120*a* and second fold line 120*b*. Each inner side panel 130*a*, 130*b* is pivotable about fold lines 120*a* and 120*b* to extend away from bottom panel 110 at an angle. Each side panel 130*a*, 130*b* is formed with a respective hook portion 132*a*, 132*b* formed on the edge of side panel 130*a*, 130*b*, away from fold lines 120*a*, 120*b*. A respective slit 134*a*, 134*b* is formed along each fold line 120*a*, 120*b*.

A top panel 140 has at least two top panel fold lines 150*a* and 150*b* along opposite sides thereof. A first outer side panel 160*a* and a second outer side panel 160*b* extend from and are pivotable about a respective fold line 150*a*, 150*b*. Panels 160*a*, 160*b* extend away from top panel 140. Each side panel 160*a*, 160*b* is provided with a respective cut out portion 162*a*, 162*b*. A respective hook 164*a*, 164*b* is disposed within opening 162*a*, 162*b* and extends from a respective side panel 160*a*, 160*b*. A second opening 166*a*, 166*b* is formed in a respective side panel 160*a*, 160*b* below respective hooks 164*a*, 164*b*. An arrow shaped tab 168*a*, 168*b* extends from a respective side panel 160*a*, 160*b* and is designed to be received through slots 134*a*, 134*b* but to prevent tab 168*a*, 168*b* from sliding back through slits 134*a*, 134*b*.

A respective middle fold line 170*a*, 170*b* extends along each outer side panel 160*a*, 160*b*, formed substantially parallel to bottom fold line 120, and bottom panel 110 and top panel 140 are relatively positioned to form an open sided enclosure (FIGS. 2–7). A first outer side panel 160*a* and second outer side panel 160*b* are each disposed adjacent a respective inner side panel 130*a*, 130*b*.

Figure 7:
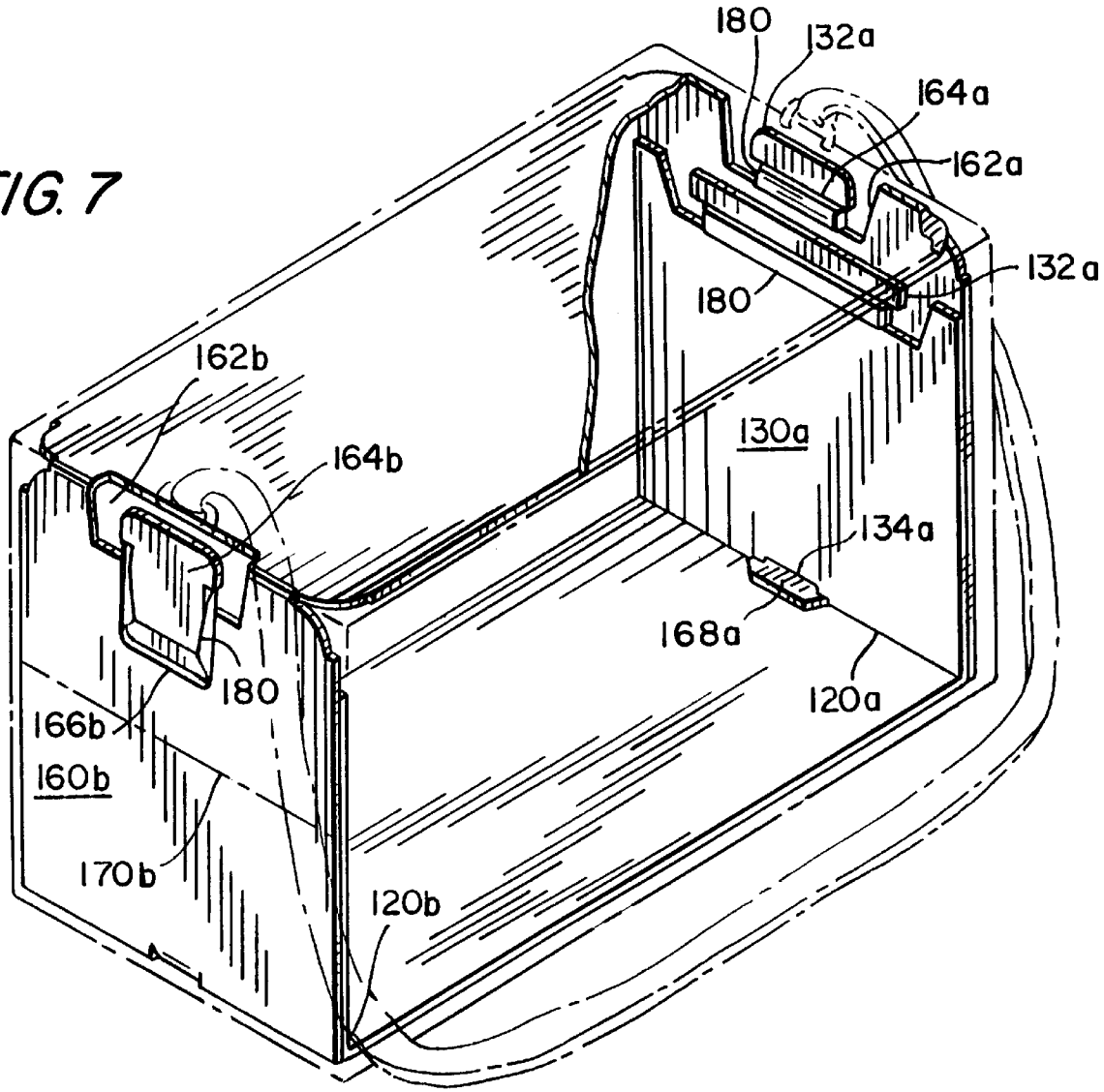
FIG. 7 is a perspective view of a soft bag containing an expander, in accordance with the first embodiment of the invention.
Figures 8, 9:
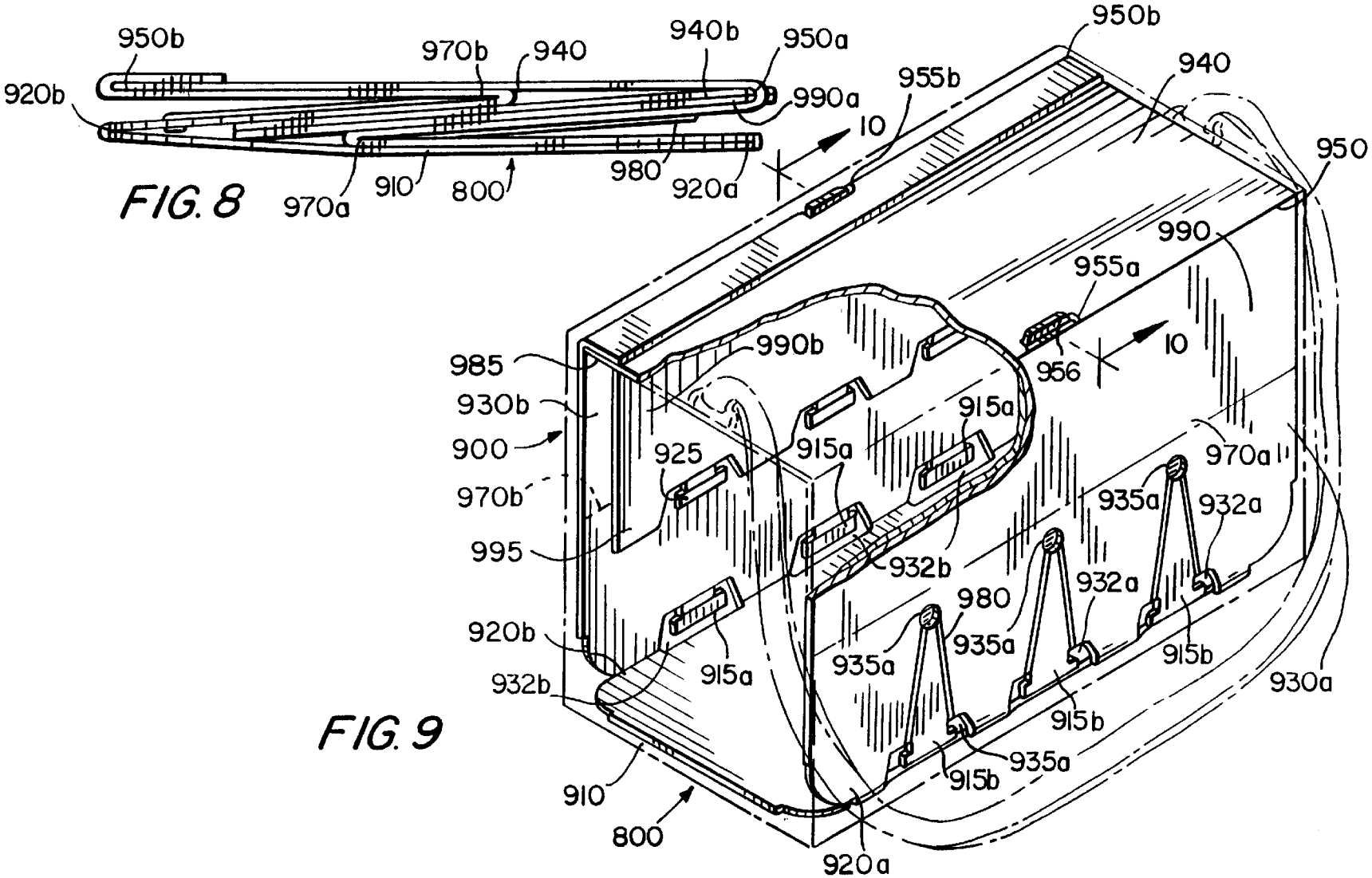
FIG. 8 is a side view of an expander in the compressed or closed position in accordance with the second embodiment of the invention.
FIG. 9 is a perspective view of a soft bag containing an expander in the open position in accordance with the second embodiment of the invention.
Figure 10:
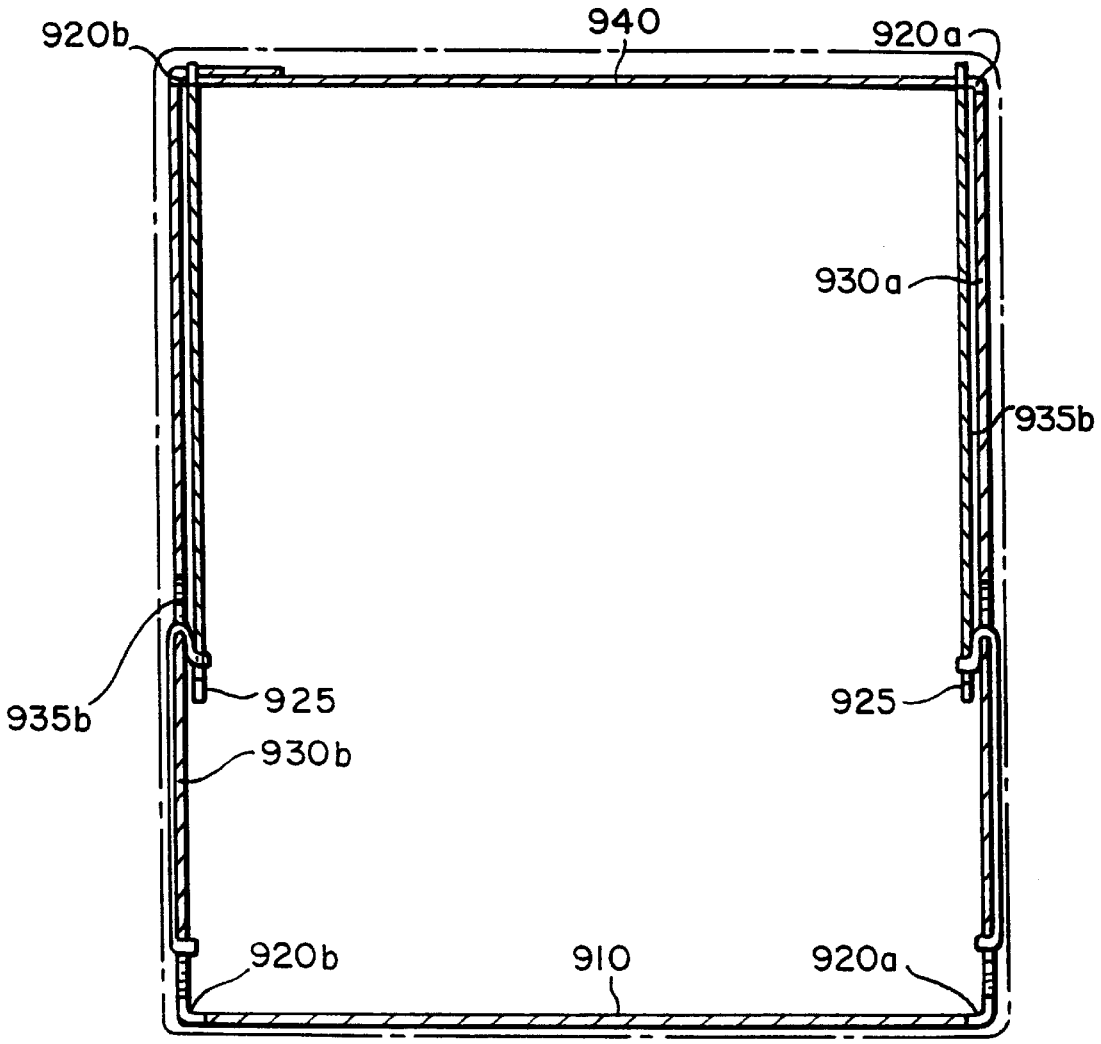
FIG. 10 is a sectional view taken along line 10—10 of FIG. 9.
Figure 11:
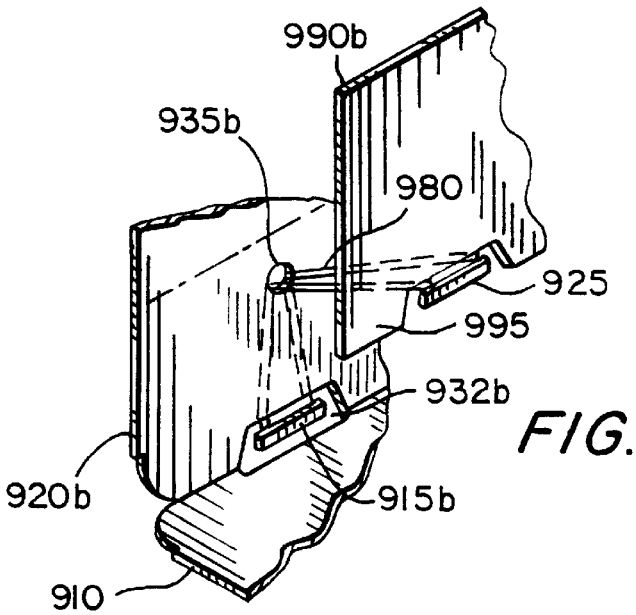
FIG. 11 is a fragmented exploded view of the expander showing the resilient member hooks and receiving holes in accordance with the second embodiment of the invention.
Figure 12:
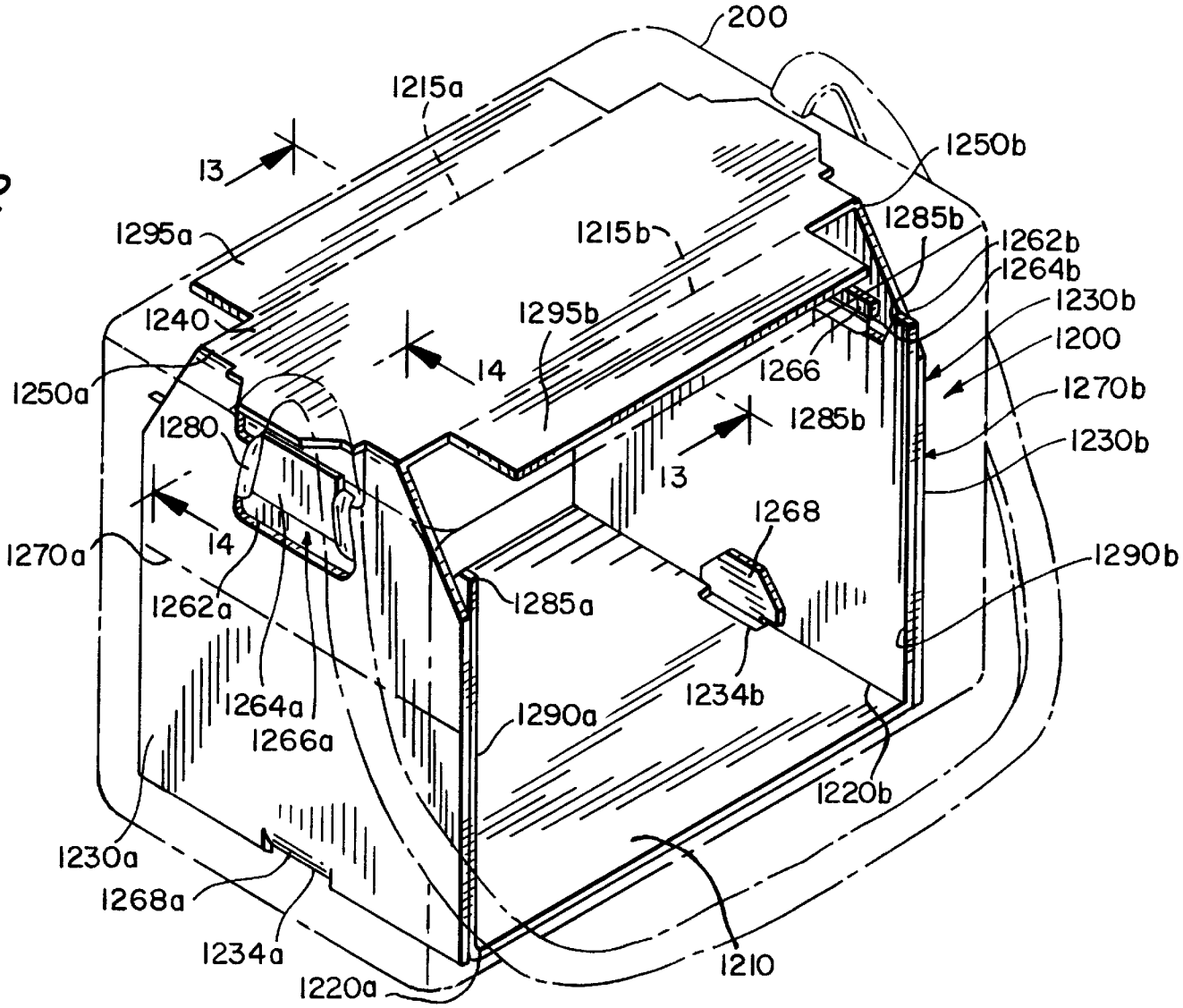
FIG. 12 is a perspective view of a soft bag containing a modified expander in the open position in accordance with the third embodiment of the invention.
Figures 13, 14, 16:
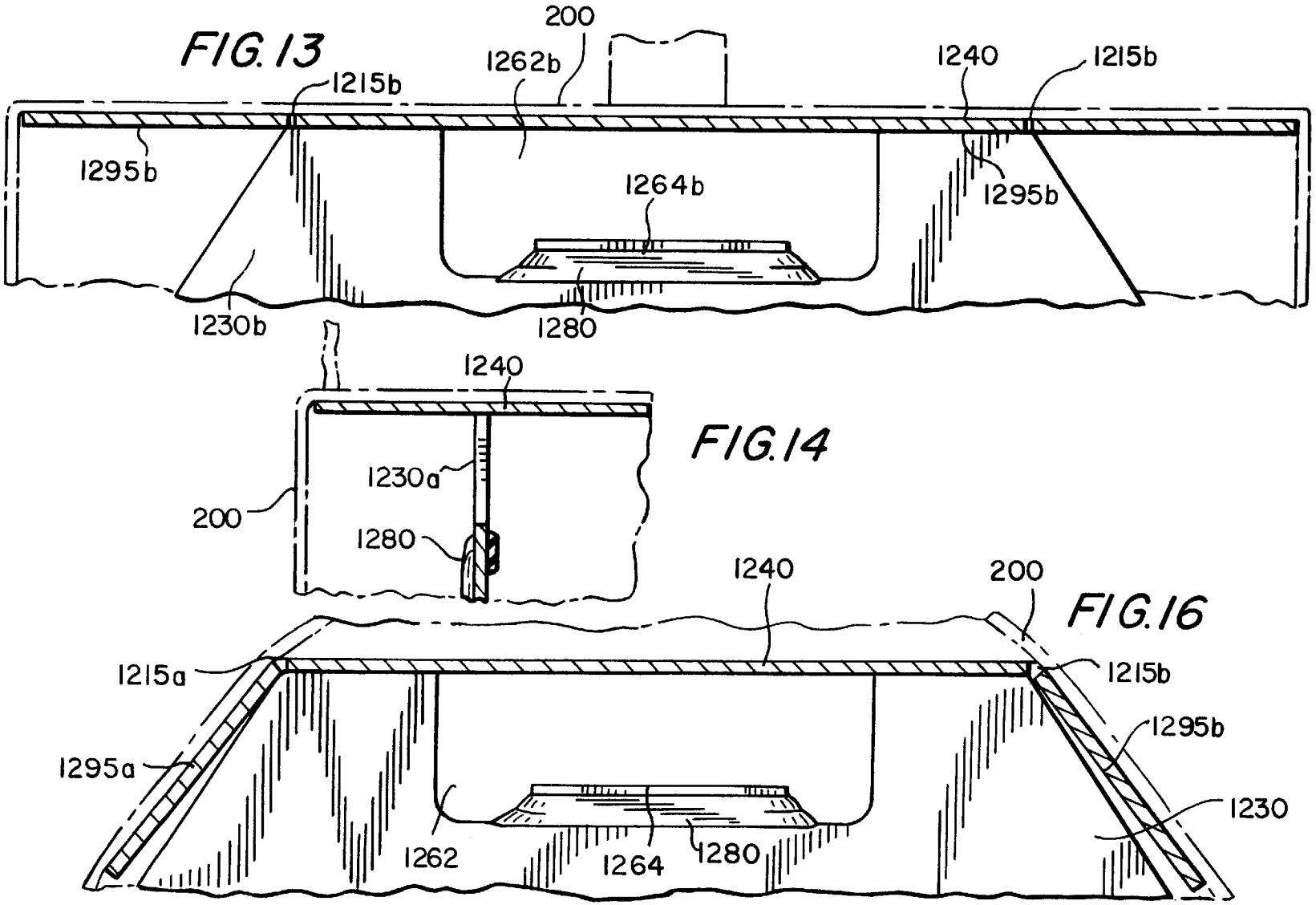
FIG. 13 is a sectional view taken along line 13—13 of FIG. 12.
FIG. 14 is a sectional view taken along line 14—14 of FIG. 12.
FIG. 16 is a cross sectional view along lines 16—16 of FIG. 15.

Each outer side panel 160 extends from a respective top panel fold line 150 to a position below each respective fold line 170. A respective resilient member 180 extends from a hook 162*a*, 162*b* through opening 166*a*, 166*b* to hook 164*a*, 164*b*. Hooks 162*a*, 162*b* are positioned closer to fold lines 150*a*, 150*b* than hooks 132*a*, 132*b* to stretch resilient member 180. Sides 160*a*, 160*b* are secured to sides 130*a*, 130*b* by tabs 168*a*, 168*b*. Resilient member 180 resiliently joins a respective one of the outer side panels 160 to a respective inner side panel 130 to bias the respective side panels 160 and 130 from a closed (collapsed) position (FIG. 8) into an open (expanded) position (FIG. 7).

Figure 4:
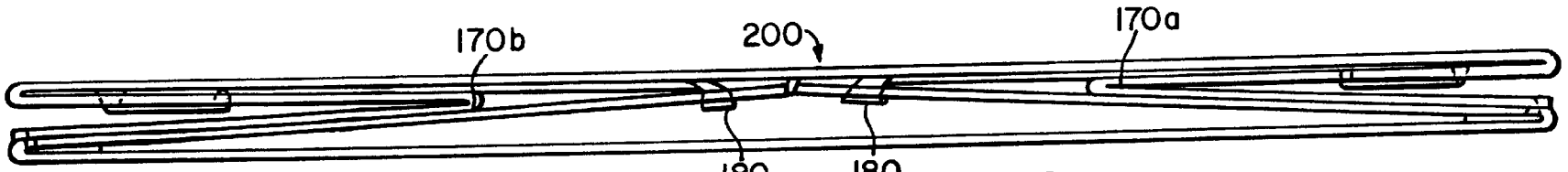
FIG. 4 is a side elevational view of an expander in the closed or compressed position in accordance with the first embodiment of the invention.
Figure 6:
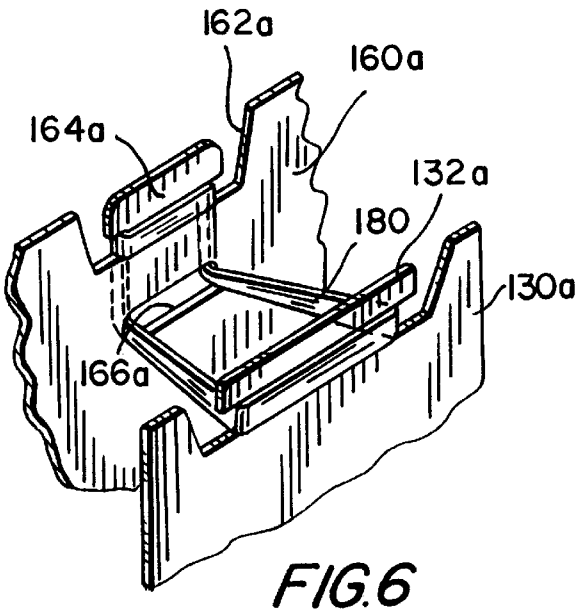
FIG. 6 is a fragmented perspective view of an expander, showing the resilient member, in accordance with the first embodiment of the invention.
Figure 5:
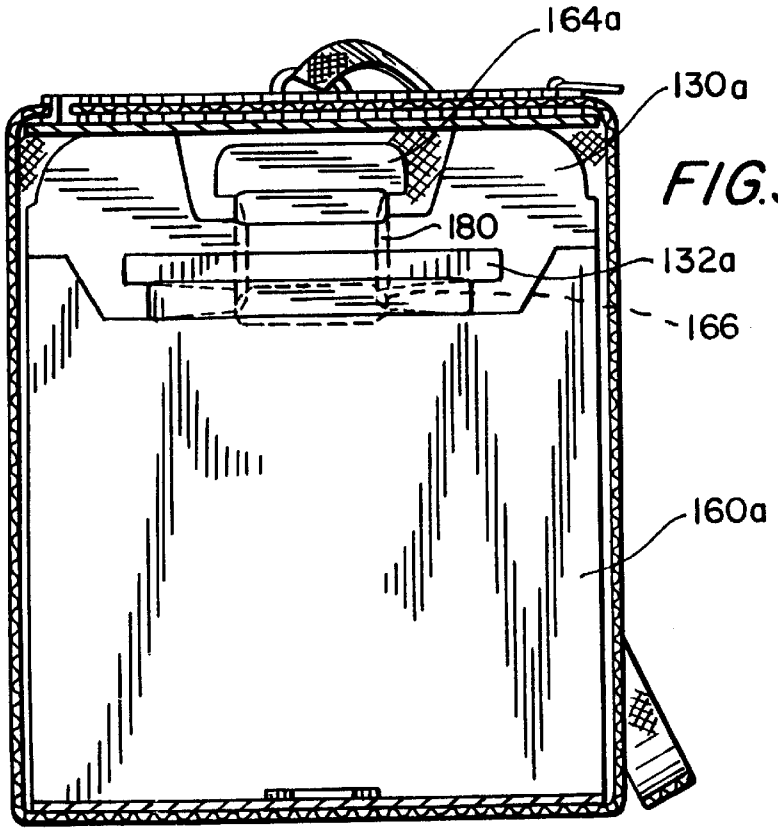
FIG. 5 is an end view of a soft bag containing an expander in accordance with the first embodiment of the invention.

Expander 100 is preferably inserted into a soft bag in the closed position as shown in FIG. 4. When expander 100 is in the closed position as in FIG. 4 top panel 140 and bottom panel 110 lie in a parallel position to each other, while each outer side panel 160*a*, 160*b* folds against itself along fold lines 170*a*, 170*b* to form a Z between the top panel 140 and the inner side panel 130. Inner side panel 130 lays nestled between the outer side panel 160 and the bottom panel 110 in the folded position. When expander 100 is in the closed position, hooks 162*a*, 162*b* are moved away from hooks 132*a*, 132*b* so that resilient member 180 is in an expanded or stretched position.

A force is applied to expander 100 to compress expander 100 and bag 200 for shipping. As shown in FIG. 3 this force may be the stacking bags 200. When the force is removed from the bag and expander unit 100, resilient member 180 contracts forcing inner side panel 130 against the fold line 170 of outer side panel 160 causing panel 160 to straighten about fold line 170, thus expanding expander 100 into an open position such that inner side panel 130 is biased adjacent to outer side panel 160. The result is a fully expanded bag containing expander 100 in the open position. The unique design of the invention gives 360° of support to the expanded bag i.e. support at multiple points filly along at least four sides.

In one preferred embodiment of the invention, the top panel 140, bottom panel 110, inner side panel 130, outer side panel 160 and the top and bottom fold lines 120 and 150 are all constructed of corrugated cardboard. It is also preferred that expander 100 employs an elastic rubber band as the resilient member 180.

Reference is now made to FIGS. 8 through 11, in which an expander, generally indicated as 800, constructed in accordance with another embodiment of the invention, is shown.

Expander 800 is similar to expander 100, the primary difference being that expander 800 can be formed as one unit of side panels, top and bottom panels and the inclusion of separate inner panels. Expander 800 includes a bottom panel 910 having at least two bottom fold lines 920*a* and 920*b* respectively along opposite sides thereof. A first side panel 930*a* and a second panel 930*b* are affixed to said bottom panel 910 along a first fold line 920*a* and a second fold line 920*b*. Each side panel 930*a*, 930*b* is pivotable about respective fold lines 920*a*, 920*b* and extend upwards from bottom panel 910. A respective middle fold line 970*a*, 970*b* transverses each side panel 930*a*, 930*b* such that respective fold lines 970*a* and 970*b* are formed substantially parallel to bottom fold lines 920*a*, 920*b*.

A plurality of openings 932*a*, 932*b* are formed in respective panels 930*a*, 930*b* adjacent fold lines 920*a*, 920*b*. Hooks 915*a*, 915*b* extend from respective side panels 930*a*, 930*b* into openings 932*a*, 932*b*. A plurality of openings 935*a*, 935*b* are disposed in respective side walls 930*a*, 930*b* between openings 932*a*, 932*b* and fold lines 970*a*, 970*b*. Top panel 940 has at least two top panel fold lines 950*a*, 950*b* respectively along opposite sides thereof. The top panel 940 is affixed to each side panel 930*a*, 930*b* along the respective top panel fold lines 950*a*, 950*b*. Top panel 940 is formed with a slot 955*a*, 955*b* along respective fold lines 920*a*, 920*b*.

A first inner panel 990*a* and a second inner panel 990*b* are each disposed adjacent to respective side panels 930*a*, 930*b*. Each inner panel 990*a*, 990*b* extends from a respective top panel fold line 950*a*, 950*b* to a position below each respective middle fold line 970*a*, 970*b*.

Side panels 995 are provided with a plurality of hooks 925 formed along one side thereof. A respective tab 956 extends from each panel 995 and is received within a respective slot 955*a*, 995*b* when tabs are received by slots 956*a*, 956*b* and a resilient member 980 extends from a hook 925 through holes 935 to hook 915 and resiliently joins a respective one side panel 920 to a respective inner panel 990 to bias the side panel 930*a* or 930*b* from a closed position and into an open position.

Two inner panels 990*a* and 990*b* have a top edge 985 and a bottom edge 995. Each inner panel 990*a* or 990*b* is flush with each respective side panel 930*a* or 930*b*. Each inner panel 990 extends downward from each top parallel fold line 950 such that the bottom edge 995 extends to a position below each respective fold line 970. Each inner panel 990 has three hooks by way of example, or protuberances 925 located on the lower portion of inner panel 990 adjacent to a corresponding receiving hole or slot 935 of side panel 930. A tab 956 extends upwards from top panel edge 985 of each respective inner panel 990. Tab 956 is received by slot 955 located at the junction of each side parallel fold line 950. A resilient member 980 extends upwards from each of hooks 915 located on side panel 930 through receiving hole or slot 935 corresponding with each hook 915 on each side panel 930 to the corresponding hook located on inner panel 925. Each resilient member 980 resiliently joins one of side panels 930 to the respective inner panel 990. Bottom panel 910 side panels 930*a* and 930*b*, inner panels 990*a* and 990*b*, top panel 940 and resilient members 980 are all constructed and arranged such that when top panel 940 and bottom panel 910 are forced towards each other, side panel 930 folds inwardly along fold lines 970*a*, 970*b* such that a distance from top panel 940 to bottom panel 910 decreases.

As with expander 100, when expander 800 is in a closed position, side panels 930*a*, 930*b* form in a shape of a Z (FIG. 8) while inner panels 990*a* and 990*b* are nestled between side panels 930*a* and 930*b* and bottom panel 910 and top panel 940. Hooks 925 are farther from hooks 915 in the closed position than in the open position, stretching elastic member 980. As in expander 100, in the absence of a compressing force, elastic member 980 will pull hooks 915 and 925 closer together causing sides 930*a*, 930*b* to straighten about fold lines 970*a*, 970*b*. Inner panels 990*a*, 990*b* prevent side panels 930*a*, 930*b* from folding upon themselves in the other direction.

Reference is now made to FIGS. 12–17 in which a modified expander generally indicated as 1200, constructed in accordance with a third embodiment of the invention is shown. Expander 1200 is similar to expander 100, the primary difference being that there are a pair of break lines 1215*a* and 1215*b* along the right and left side of a top panel 1240.

Expander 1200 is disposed within a soft bag 200 and includes a bottom panel 1210 having at least two bottom fold lines 1220*a* and 1220*b* along opposite sides thereof. A first inner side panel 1290*a* and a second inner side panel 1290*b* are joined to said bottom panel 1210 along the first fold line 1220*a* and the second fold line 1220*b*. Each inner side panel 1290*a*, 1290*b* is pivotable about fold lines 1220*a* and 1220*b* to extend away from bottom panel 1210 at an angle. Each inner side panel 1290*a*, 1290*b* is formed with a respective hook portion 1266*a*, 1266*b* formed on an edge 1285 of inner side panel 1290*a*, 1290*b*. There is a slit 1234*a*, 1234*b* formed along each fold line 1220*a*, 1220*b*.

Top panel 1240 has at least two top panel fold lines 1250*a* and 1250*b* along opposite sides thereof. A first outer side panel 1230*a* and a second outer side panel 1230*b* extend from and are pivotable about each respective fold line 1250*a*, 1250*b*. Panels 1230*a*, 1230*b* extend away from top panel 1240. Each side panel 1230*a*, 1230*b* is provided with a respective cut out portion 1262*a*, 1262*b*. A respective hook 1264*a*, 1264*b* is disposed within opening 1262*a*, 1262*b* and is formed along the top edge 1285*a*, 1285*b* of inner side panel 1290*a*, 1290*b*. An arrow shaped tab 1268*a*, 1268*b* extends from each respective side panel 1230*a*, 1230*b* and is designed to be received through slots 1234*a*, 1234*b*.

A respective middle fold line 1270*a*, 1270*b* extends along each outer side panel 1230*a*, 1230*b* formed substantially parallel to bottom fold 1220*a*, 1220*b* and bottom panel 1210 and top panel 1240 are relatively positioned to form an open sided enclosure. First outer side panel 1230*a* and second outer side panel 1230*b* are each disposed against each respective inner side panel 1290*a*, 1290*b*. Each outer side panel 1230*a*, 1230*b* extends from a respective top panel fold line 1250*a*, 1250*b* to a position below each respective fold line 1270*a*, 1270*b*. A respective resilient member 1280 extends from hook 1264*a* through opening 1262*a* to hook 1266*a*, 1266*b*. Sides 1230*a*, 1230*b* are secured to sides 1290*a*, 1290*b* by tabs 1268*a*, 1268*b* which are inserted into slits 1234*a*, 1234*b*. Resilient member 1280 resiliently joins each respective outer side panel 1230*a*, 1230*b* to respective inner side panels 1290*a*, 1290*b* to bias respective side panels 1230*a*, 1230*b* and 1290*a*, 1290*b* from a closed (collapsed position) into an open (expanded position).

Expander 1200 is inserted into a soft bag similar to expander 100 as shown in FIG. 4. When expander 1200 is in the closed position, top panel 1240 and bottom panel 1210 lie in parallel position to each other, while each outer side panel 1230*a*, 1230*b* folds against itself along fold lines 1270*a*, 1270*b* to form a Z shape between top panel 1240 and inner side panels 1290*a*, 1290*b*. Inner side panels 1290*a*, 1290*b* lay nestled between outer side panels 1230*a*, 1230*b* and bottom panel 1210 in the folded position. When expander 1200 is in the closed position, hooks 1264*a*, 1264*b* are moved away from hooks 1266*a*, 1266*b* so that each resilient member 1280 is in an expanded or stretched position. A force is applied to expander 1200 to compress expander 1200 and bag 200 for shipping. When the force is removed from soft bag 200 and expander 1200, resilient member 1280 contracts force in inner side panels 1290*a*, 1290*b* against fold line 1270 of outer side panels 1230*a*, 1230*b* causing panels 1230*a*, 1230*b* to straighten about fold lines 1270*a*, 1270*b* thus expanding expander 1200 into an open position such that inner side panels 1290*a*, 1290*b* are biased against each outer side panel 1230*a*, 1230*b*. The result is a fully expanded bag 200 containing an expander 1200 in the open position. The unique design of the invention gives 360 degrees of support to the expanded bag i.e. support at multiple points fully along at least four sides.

Figure 15:
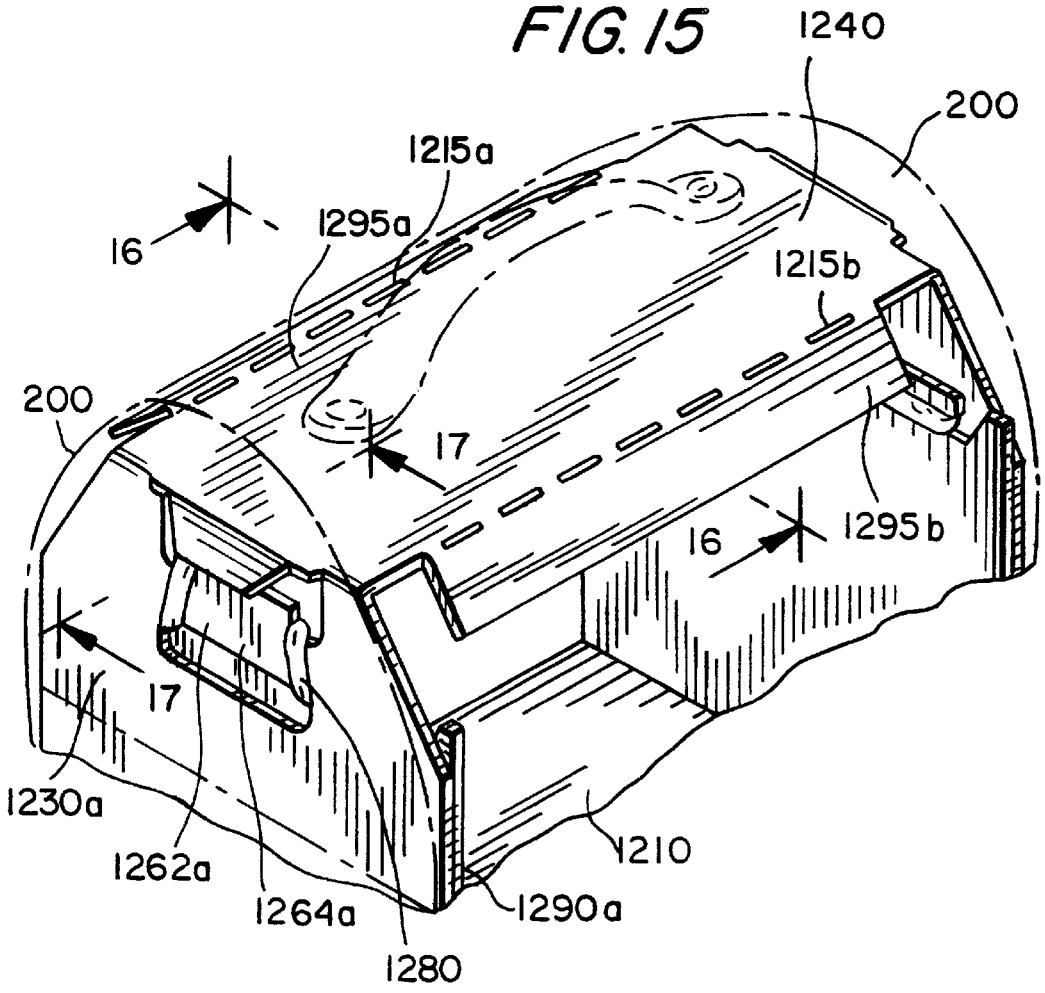
FIG. 15 is a fragmented exploded view of an expander in accordance with the third embodiment of the invention.
Figure 17:
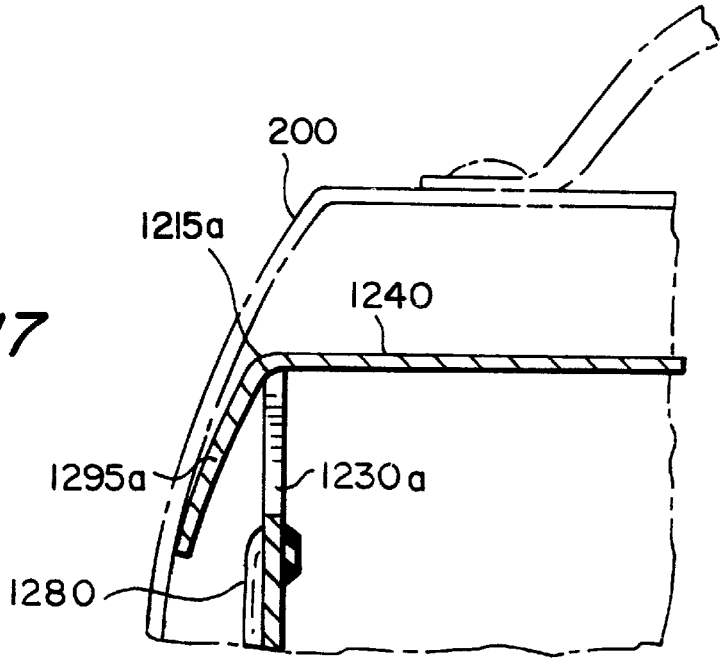
FIG. 17 is a cross sectional view taken along line 17—17 of FIG. 15.

In this third embodiment, top panel 1240 has two break lines 1215*a* and 1215*b* along each side. Joined to each break line are top panel tabs 1295*a* and 1295*b*, which fold downward from top panel 1240 when the bag is filly expanded in a satchel or tapered soft bag 200 as shown in FIG. 15. Break lines 1215*a*, 1215*b* permit the top of expander 1200 to conform closely to the shape of the top of bag 200.

One embodiment of the invention includes the bottom panel having at least two bottom fold lines along opposite sides thereof with a first inner side panel and a second inner side panel affixed to said bottom panel along the first fold line and a second fold line and each inner side panel being rotatable about the fold line to extend upwards from the bottom panel; a top panel having at least two top panel fold lines along opposite sides thereof; a first outer side panel and a second outer side panel, each outer side panel being disposed on a respective inner side panel, and a respective middle fold line transversing each outer side panel formed parallel to the bottom fold line and each outer side panel extending from a respective top panel fold line to a position below each respective fold line; a resilient member resiliently joining a respective one of the outer side panels to a respective inner side panel to bias the respective side panels from a closed position into an open position, the inner side panels being positioned adjacent to the bottom panel in the closed position and the inner side panel extending upwards from the bottom panel in the open position.

At the point of insertion of the bag expander into a soft bag, the expander is in the closed position. When the expander is in the closed position the top panel and the bottom panel lay parallel to each other while the outer side panel forms a Z between the top panel and the inner side panel and the inner side panel lays nestled between the outer side panel and the bottom panel. When the invention is in the closed position the resilient member is in an expanded position. When force is removed from the bag or expander unit, the resilient member contracts forcing the inner side panel against the fold line of the outer side panel and expanding the invention into an open position such that the inner side panel is biased adjacent to the outer side panel. The outer side panel extending beyond the fold line prevents the inner side panel from folding in the opposite direction, providing structural integrity. The unique design of the invention gives 360 degrees of support to the expanded bag.

A preferred embodiment of the invention employs an elastic rubber band as the resilient member. In this embodiment, a hook shaped protuberance can be disposed on the inner side panel. On the outer side panel, another hook is disposed above the respective hook on the inner side panel and a slot is disposed on the outer side panel below both the hook on the inner side panel and the outer side panel. The resilient member extends upwards from the hook on the inner side panel through the slot disposed on the outer side panel and is joined to the corresponding hook on the outer side panel.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing(s) shall be interpreted as illustrative and not in a limiting sense.

Particularly it is to be understood that in said claims, ingredients or compounds recited in the singular are intended to include compatible mixtures of such ingredients wherever the sense permits.

What is claimed is:

1. A soft bag expander, comprising:

a bottom panel having at least first and second fold lines along opposite edges thereof;

a first inner side panel and a second inner side panel joined to said bottom panel along the first fold line and the second fold line, respectively, each inner side panel being pivotable about the fold line to extend away from and towards the bottom panel;

a top panel having at least two top panel fold lines along opposite edges thereof, two break lines perpendicular to the top panel fold lines and tabs joined to the top panel along said break lines;

a first outer side panel and a second outer side panel, each outer side panel being disposed on a respective inner side panel, a respective inner side fold line transversing each outer side panel parallel to the bottom fold line, each outer side panel extending from a respective top panel fold line to a position beyond each respective inner side panel;

a resilient member resiliently joining a respective one of the outer side panels to a respective inner side panel to bias the respective side panels from a closed position into an open position, the inner side panels being positioned adjacent to the bottom panel in the closed position and the inner side panel extending away from the bottom panel in the open position.

2. The soft bag expander of claim 1, wherein the top panel, bottom panel, outer side panels and inner side panels are all nested when the expander is in the closed position.

3. The soft bag expander of claim 1, wherein the top panel, bottom panel, outer side panels and inner side panels are constructed and arranged to form a Z shape and move from the open position to the closed position as force is exerted on the top panel.

4. The soft bag expander of claim 1, wherein the top panel, bottom panel, outer side panels and inner side panels are constructed of corrugated cardboard.

5. The soft bag expander of claim 1, wherein each resilient member is an elastic rubber band.

6. The soft bag expander of claim 1, wherein the tabs of the top panel fold downward when the expander is placed in a bag with a tapered top to conform generally to the shape of the top of the bag.

* * * * *